United States Patent [19]

Corcoran, Jr.

[11] 4,176,739

[45] Dec. 4, 1979

[54] COIN ACTUATED TIMER WITH AUDIO OUTPUT

[76] Inventor: Edward J. Corcoran, Jr., 4528 W. Shaw Butte, Glendale, Ariz. 85304

[21] Appl. No.: 876,747

[22] Filed: Feb. 10, 1978

[51] Int. Cl.[2] ..... G07F 17/00

[52] U.S. Cl. ..... 194/9 T; 194/16; 194/DIG. 18

[58] Field of Search ..... 194/1 R, 8, 9 T, 16, 194/DIG. 18

[56] References Cited

U.S. PATENT DOCUMENTS

| | | | |
|---|---|---|---|
| 3,165,185 | 1/1965 | Moore | 194/9 T |
| 3,370,686 | 2/1968 | Wilcox | 194/9 T |
| 3,923,134 | 12/1975 | Rezazadeh | 194/9 T |

*Primary Examiner*—Joseph J. Rolla

*Attorney, Agent, or Firm*—H. Gordon Shields

[57] ABSTRACT

Electro-mechanical apparatus is disclosed which includes a coin actuated timer electronically linked to an audio output to provide an audio output at the end of a pre-determined time period selected by the user and responsive to coins inserted into the apparatus.

9 Claims, 6 Drawing Figures

COIN ACTUATED TIMER WITH AUDIO OUTPUT

BACKGROUND OF THE INVENTION

1. Field of the Invention

This invention relates to timing apparatus, and, more particularly, to coin actuated time apparatus having an audio output.

2. Description of the Prior Art

Coin operated alarm clocks have been known for many years. Other types of clock equipment are currently used, such as parking meters. The typical situation with prior art apparatus is the insertion of a coin used as the basis of a predetermined time period. With coin operated alarm clocks, the predetermined time period ends and a spring wound bell or buzzer provides an audio output for a brief period of time. In parking meters, at the end of a predetermined period of time which is responsive to the number and type of coins inserted into the parking meter, a visual indication, usually in the form of a red violation indicator, is released.

In each of these situations discussed briefly in the preceding paragraph, the clock or time keeping mechanism is spring actuated. The use of a spring to actuate the time keeping apparatus is less expensive than one powered by electrical or other energy, and the spring may typically be wound by the turning of a handle which accompanies the insertion of a coin.

In U.S. Pat. No. 1,149,130, a coin operated savings bank is disclosed. The savings bank is the receptacle for the clock secured thereto. The clock operates in response to the insertion of coins and in order to keep the clock running, coins must be fed into it on a regular basis. There is accordingly a "forced" savings program established simply in order to operate the clock. The coins may be removed from the savings bank portion of the apparatus only upon the accumulation of a certain quantity of coins.

A coin operated alarm clock is disclosed in U.S. Pat. No. 2,625,249. A somewhat similar type alarm clock is shown in U.S. Pat. No. 3,871,502. In both patents, the alarm clocks are assigned for use in hotel rooms and similar places, which have a source of electricity available. The apparatus is electrically operated, with a coin allowing the electrical circuitry to operate.

A parking meter in common usage for parking motor vehicles is not connected to a source of electrical energy, but rather is entirely dependent upon spring energy, such as in a coil spring, for actuation. The turning of a handle after a coin has been inserted, winds the spring so as to provide energy to operate the timer for a particular period of time. As additional coins, or a different denomination of coin, are inserted into the apparatus, the turning of the handle with the insertion of each coin adds running time to the parking meter. When the time has elapsed, a spring actuated visual indication is presented.

SUMMARY OF THE INVENTION

The invention described and claimed herein comprises programmable electronic apparatus for a coin-actuated timer and an audio output. The apparatus is programmable in accordance with predetermined perameters for the length of time desired, and mechanical switches may be set by a user through the predetermined time selected by the user and at the end of the preselected time an audible alarm is sounded by an audio frequency tone generator. A pair of coins are required to activate the apparatus and, once activated, the insertion of additional coins has no effect until the end of the predetermined time periods. The insertion of two coins is required in order to activate the apparatus and the time period selected by the user is accordingly not dependent on the number of coins inserted into the apparatus, but rather, simply on the insertion of the two coins and the selection of the desired time period by mechanical movement of a switch which is in turn connected to the circuit apparatus.

Among the objects of the present invention are the following:

To provide new and useful timer apparatus;

To provide new and useful coin operated timer apparatus;

To provide new and useful timing apparatus having an audio output;

To provide new and useful timer apparatus which sounds an audible signal for a predetermined length of time at the end of an elapsed period of time; and To provide new and useful apparatus in which a trigger pulse may be sustained for an indefinite period of time while the output pulse of the apparatus may vary.

DESCRIPTION OF THE PREFERRED EMBODIMENT

Figure 1:
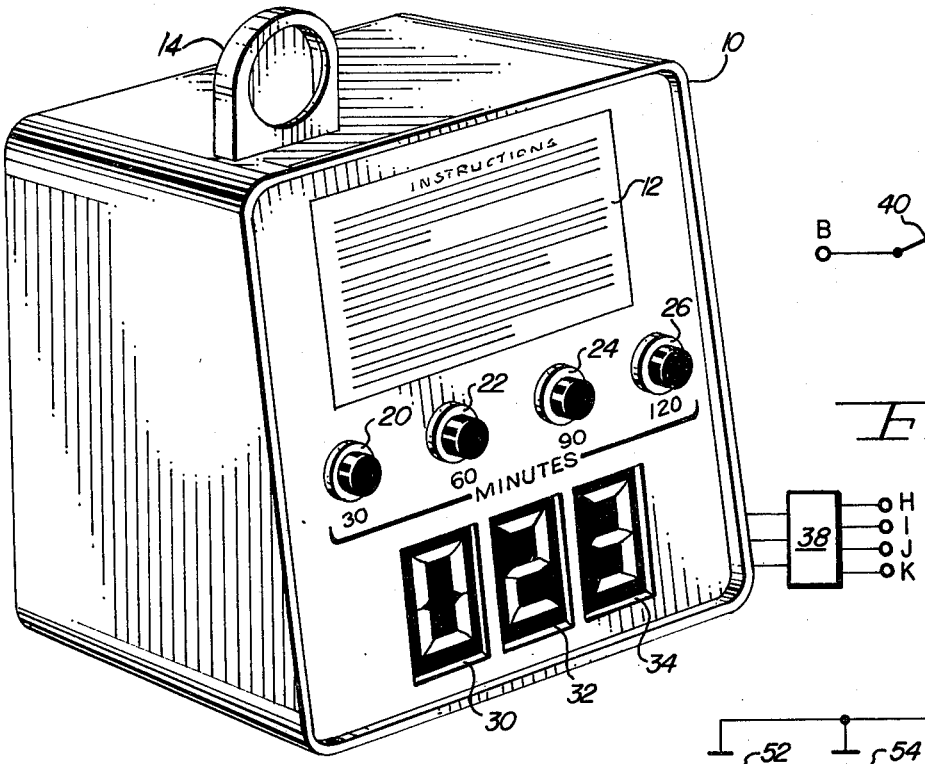
FIG. 1 is a schematic representation of the exterior of apparatus embodying the present invention.

FIG. 1 comprises a schematic representation of a housing 10 which encloses the apparatus of the present invention. The housing 10 is shown as being generally rectangular in configuration, but it is obvious that any appropriate, contemporary style housing may be used. The housing 10 includes an instruction plate 12 on which are printed instructions for use of the apparatus. Sequentially, after reading the instructions, a user inserts coins in a coin receptor 14 which is disposed on the top of the housing 10. For illustrative purposes herein, two quarters are required to actuate the apparatus of the present invention and accordingly a user inserts two quarters sequentially into the coin receptor 14. After the quarters have been inserted, the user is then directed to four time-select switches which are preferably located beneath the instruction plate 12. The time selector switches include a thirty-minute or one-half hour selector switch 20, a sixty-minute or one-hour selector switch 22, a one-and-one-half hour or ninety-minute selector switch 24, and a one-hundred-twenty or two-hour time selector switch 26. The user may select any of the time periods by actuating or depressing any one of the switches 20, 22, 24, or 26. It will be noted that regardless of the time selected, the cost is the same, namely fifty cents or two quarters.

At the lower portion of the housing 10, and beneath the time selector switches, are three digital readout indicators, including an hour readout indicator 30, a tens of minutes readout indicator 32, and a minutes readout indicator 34. The readout indicators indicate the time remaining after the coins have been inserted into the coin receptor 14 and the appropriate time selected by depressing one of the time selector switches 20, 22, 24, or 26. Three conductors are shown extending between an interface circuitry block 38 for connection to the readout digits 30, 32, and 34. The interface circuitry will be discussed below.

Figure 2:
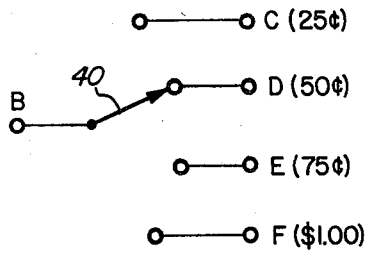
FIG. 2 is a schematic representation of coin select apparatus included in the present invention.
Figure 4:
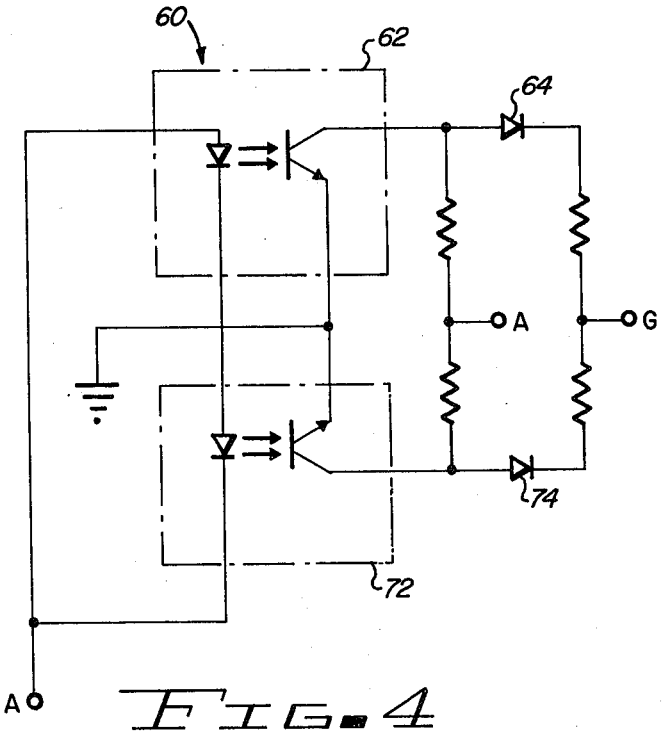
FIG. 4 is a schematic representation of optoisolator apparatus included in the present invention.
Figure 5:
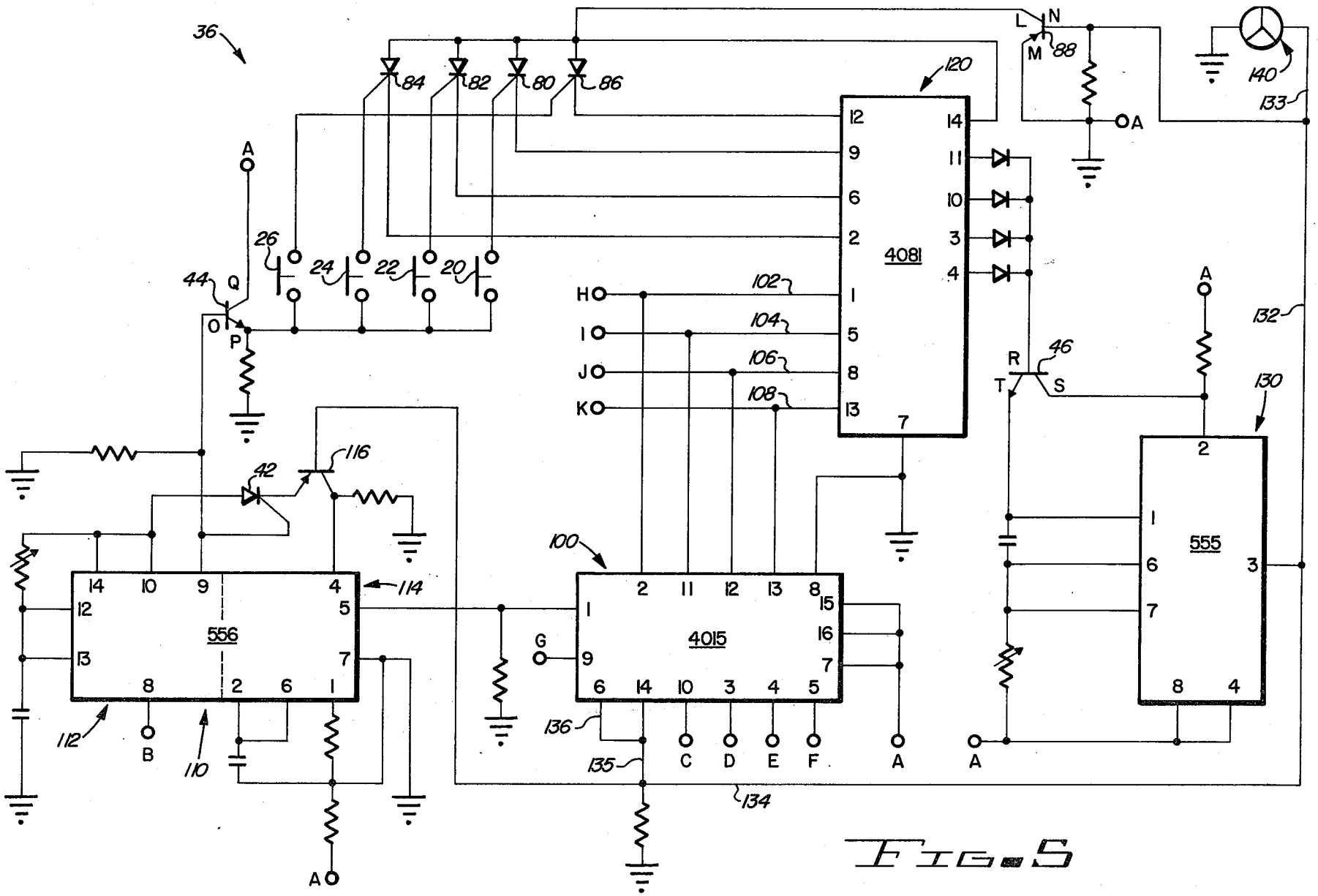
FIG. 5 is a schematic diagram of circuitry used in the present invention.

FIG. 2 is a schematic representation of a coin selector switch 40 which is employed internally of the apparatus and is associated with the optoisolators illustrated schematically in FIG. 4 and also illustrated in conjunction with the schematic diagram comprising FIG. 5.

The coin selector switch 40 is connected to terminal B and the switch may be rotated to connect with either terminal C, terminal D, terminal E, or terminal F. The terminals C, D, E, and F, respectively represent the insertion of a single quarter, two quarters, three quarters, or four quarters. That is, by selecting or connecting the switch 40 to the appropriate terminal C, D, E, or F, the installer/proprietor may pre-select the number of coins required to operate the timer apparatus. As indicated in FIG. 2, and as discussed herein, switch 40 is connected to terminal D which determines that two quarters (fifty cents) are required to operate the apparatus. The significance of terminal B and terminals C, D, E, and F will be explained in detail below.

Figure 3:
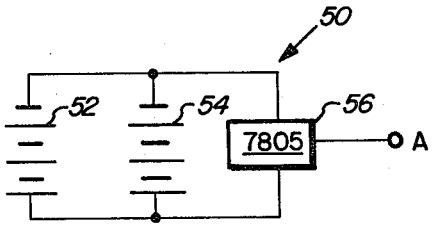
FIG. 3 is a schematic representation of power supply usable in apparatus of the present invention.

FIG. 3 is a schematic diagram of power supply apparatus 50 usable with apparatus of the present invention. A pair of batteries 52 and 54 are connected in parallel with a monolithic voltage regulator integrated circuit 56. The batteries 52 and 54 may be any appropriate voltage source, such as a pair of lantern batteries. The integrated circuit 56 is in turn connected with terminal A which comprises the power supply for the apparatus of the present invention. It will be noted that by using lantern batteries for batteries 52 and 54, the circuitry apparatus of the present invention should last for many months under virtually continuous use. The circuitry, including the integrated circuits and other circuit components involved in the apparatus of the present invention have been chosen, in part, for their low power consumption. As will be noted in conjunction with FIGs. 4 and 5, terminal A, the voltage source or supply, is connected to the circuitry at a plurality of different, required, locations. The voltage regulator 56 may be a 7805 IC.

FIG. 4 is a schematic representation of a pair of infrared LED optoisolators connected together and used in conjunction with the coin receptor apparatus 14, shown schematically in FIG. 1. FIG. 4 accordingly comprises an optical coin identification circuit 60. The circuit 60 includes a light emitting diode and a phototransistor. The optoisolators 62 and 72 are connected together, as shown in FIG. 4, with the anodes of the light emitting diodes (LED's) connected to a common terminal A, the power supply terminal (see FIG. 3) and the cathodes of the LED's also connected together and to a ground. The ground is also common to the emitters of the phototransistors. The collectors of the phototransistors are in turn connected to voltage supply terminal A through appropriate resistors, and also through a pair of diodes and resistors to terminal G.

In practice, the coin receptor 14 is adjusted with respect to the optoisolators 62 and 72 such that only the outer edge of a quarter breaks the light beam between each LED and its phototransistor. In this manner, a false triggering of the apparatus or enabling of the apparatus will not occur by using a coin other than a quarter. The transistors in the optoisolator are always in their "on" state. However, the output is blocked by diodes 64 and 74, which are respectively tied to the phototransistors in the optoisolators 62 and 72. With the output of the transistors blocked, terminal G is "off". It is only when both optoisolator 62 and 72 have their respective light beams broken by appropriate coins, such as quarters as discussed herein, will terminal G see a positive voltage. Accordingly, only a quarter coin will provide a positive voltage output to terminal G by breaking the light beam in the optoisolators.

FIG. 5 is a schematic circuit diagram of the timing apparatus of the present invention. As indicated above, the particular components represented in FIGS. 1, 2, 3, and 4 are also represented in FIG. 5. The various components are shown in FIG. 5 as required to illustrate the functioning of the present invention. The schematic circuit diagram of FIG. 5 is generally designated by reference numeral 36.

As shown in FIG. 5, four discrete integrated circuit modules are used in the apparatus of the present invention. One of the integrated circuit packages is a shift register 100, typically a 4015; one is a dual timer IC 110, typically a 556; one is a quad, two-pole AND-gate integrated circuit 120, typically a 4081; and the last one is a timer 130, typically a 555. In the following discussion, where necessary, a particular pin of one of the IC modules will be identified by number.

In operation, the optoisolator 60 is connected to terminal G, which is in turn the input terminal to pin 9 of the shift register IC 100. The input to pin 9 from terminal G produces a pulse which is in turn seen at terminals C, D, E, and F which are connected to the respective pins 10, 3, 4, and 5 of the shift register 100. It will be noted that terminals C, D, E, and F are in turn connected by a switch 40 to terminal B in the coin select circuitry discussed above in conjunction with FIG. 2. Terminal B is in turn connected to pin 8 of one-half of the dual timer IC 110, designated herein as timer half 112.

The first coin inserted into the coin receptor 14 produces an output pulse on terminal G which is seen at terminal C, but terminal C is not connected to the switch 40. The second coin inserted into the optoisolator 60 produces another output pulse on terminal G which results in a pulse seen at terminal D because of the shifting action of the shift register 100. With switch 40 connected to terminal D, the pulse seen at D is in turn transmitted through switch 40 to terminal B and pin 8 of the timer half 112 of dual timer 110. The input to terminal 8 triggers the startup circuit at timer half 112 of the dual timer 110. The timing circuit of one-half of the dual timer 110 is preset for a period of fifteen seconds and accordingly the initial timer portion of 110, designated by reference numeral 112, is "on" for fifteen seconds after being triggered.

While timer half 112 is "on" for fifteen seconds, output from pin 9 of timer half 112 turns on an SCR designated by reference numeral 42, and the output from pin 9 of timer half 112 also turns on switching transistor 44. The switching transistor 44 turns on the selector swtiches 20, 22, 24, and 26 to allow the user of the apparatus to select the appropriate time by depressing one of the momentary switches 20, 22, 24, or 26, illustrated in FIG. 5 and also in FIG. 1. It will be noted that one of the selector switches 20 . . . 26 must be depressed within the fifteen second time interval during which the half timer 112 is "on" because transistor 44 turns "off" at the expiration or termination of the fifteen second time period when the half timer 112 turns off. If no time is selected furing that fifteen second time period by the expiration of one of the selector switches 20 . . . 26, two additional coins must be inserted in order to reactivate the apparatus by again triggering the half timer 112.

The switches 20 . . . 26 are connected respectively to the gates of four SCR's are in turn connected to input pins of the quad, two pole AND-gate IC 120. The input to IC 120 from the SCR's 80, 82, 84, and 86 provides the bias for one side of the respective discrete AND-gates within IC 120 in accordance with the respective connections. That is, SCR 84, when turned on by switch 24, is connected to pin 2 of IC 120, and pin 2 comprises one-half of a single AND-gate within IC 120. Similarly, when switch 22 is closed, SCR 82 is turned on to provide a bias to input pin 6 of IC 120 which is connected to one-half of another AND-gate. In a similar fashion, SCR's 80 and 86 are respectively turned on by switches 20 and 26 to provide a bias to pins 9 and 12 of IC 120 which each comprise one-half of two additional AND-gates.

Thus an input to terminal B, connected to pin 8 of timer half 112 of timer 110 results in a limited, fifteen second, time period during which the appropriate, desired time interval may be selected by a user by selecting any one of the switches 20, 22, 24, or 26. The depression of the switches, which are momentary switches, as indicated above, spring biased to the "off" position, results in the turning on of one of the SCR's, respectively 80, 82, 84, and 86, and the turning on of one of the SCR's results in an input to one-half of an AND-gate in IC 120.

At the same time, the second half of dual timer 110, comprising a timer half 114, is activated. The timer half 114 comprises an electronic clock which produces a substantially constant output at a frequency of one millihertz, or once each 16.67 minutes. That is, the output of timer half 114 comprises a positive pulse lasting sixteen and two-thirds minutes, and a negative pulse lasting sixteen and two-third minutes, for a total cycle of 33⅓ minutes. The timer half 114 is turned on by the output of SCR 42 through a switching transistor 116 connected to pin 4 of timer half 114 of the dual timer 110. The transistor 116 is normally on. When it is momentarily turned off, as will be described below, the timer IC 110 is reset.

With each positive transistion of the one millihertz pulsed output from pin 5 of timer half 114 of pin 1 of shift register 100, there is one shift of the shift register 100 with respect to pins 2, 11, 12, and 13, and the output from the pins 2 . . . 13 is appropriately transmitted to the complementary pins 1, 5, 8, and 13, respectively, of AND-gate IC 120. If both complementary pins of AND-gate IC 120 are biased on equally, then the output from the AND-gates to the pins 4, 3, 10, and 11 of the IC 120 through diodes connected to each output pin is "on" to transistor 46. If there is no equal bias on the complementary pins of each AND-gate, then the respective AND-gates are "off". With respect to the AND-gate IC 120, the complementary pins for the four AND-gates included in IC 120 comprise input pins 2, 6, 9, and 12, and pins 1, 5, 8, and 13. The output pins from the four AND-gates include pins 4, 3, 10, and 11.

The time period initially selected is, as described above, manifest by the actuation of one of the switches 20 . . . 26, which results in the turning on of one of the corresponding SCR's 80 . . . 86. As previously indicated, each SCR is connected to one of a pair of inputs of AND-gates within IC 120. Accordingly, the actuation of a switch and the turning on of an SCR results in an input to one-half of an AND-gate. The other halves of the respective AND-gates are tied to one of the pins 2, 11, 12, or 13 of IC 100. As the shift register IC 100 receives an input from the clock timer half 114 in IC 110, the second inputs to the four AND-gates and consecutively turned on by the outputs from the shift register IC 100. The four AND-gates will consecutively receive an input, but only the AND-gate receiving a signal from an SCR will provide an output in response to the consecutive outputs from the shift register 100. Accordingly, at the end of the preselected time period, an output will result from one of the AND-gates in IC 120 through a blocking diode to the base of transistor 46.

If one of the AND-gates is "on", then there will be an output through a diode from one of the AND-gate outputs 4, 3, 10, or 11, to the base of transistor 46 which causes transistor 46 to turn on. When transistor 46 turns on and conducts, timer 130, which comprises an integrated circuit, is turned on. IC timer 130 comprises a reset circuit having a timing out period of ten seconds after being triggered. When the IC 130 turns on, four different occurrences transpire substantially simultaneously.

One occurrence is that the SCR's 80, 82, 84, and 86 are turned off, which in turn causes the AND-gates in IC 120 to turn off. The SCR's 80, 82, 84, and 86 are turned off when a switching transistor 88 is turned off by the output from pin 3 of IC 130 through conductor 132 to the base of the transistor 88, which turns the transistor 88 off.

The second occurrence is that the shift register 100 is reset through conductors 134, 135, and 136 extending between pin 3 of IC 130 and pins 6 and 14 of IC 100.

The third occurrence which transpires when reset timer IC 130 turns on is the resetting of both sides of timer IC 110. Timer halves 112 and 114 of IC 110 are reset by the output of pin 3 of IC 130 through conductor 134 to the base of a switching transistor 116, which turns the transistor 116 off.

The fourth occurrence is the turning on of an audio output element 140, which may be any of the oscillators, well-known in the market, such as the Mallory SC 628P. Audio element 140 is turned on by the output from pin 3 of IC 130 through conductors 132 and 133.

The IC 130 is in an "on" state for ten seconds, after which time it turns off, causing the audio element 140 to also turn off and, at the same time, allows transistors Q2 and Q4 to return to their normal "on" state. It will be noted that transistors 44, 88, and 116 are switching transistors and accordingly may be referred to simply as "switches". However, transistor 46 is a high current switch, whose purpose is to switch the high current required for timer IC 130, as opposed to the simple "on" and "off" function of transistors 44, 88, and 116.

When timer IC 130 turns off, the timer apparatus is then ready for the next customer or user who inserts a pair of quarters into the coin receptor 14, shown in FIG. 1.

Between IC's 100 and 120 are four conductors, namely conductor 102 extending between pin 2 of IC 100 and pin 1 of IC 120, conductor 104 extending between pin 11 of IC 100 and pin 5 of IC 120, conductor 106 extending between pin 12 of IC 100 and pin 8 of IC 120, and conductor 108 extending between pin 13 of IC 100 and pin 13 of IC 120. Each of the conductors 102, 104, 106, and 108 includes a terminal connection designated respectively as terminals H, I, J, and K. The terminals H, I, J, and K are connected to interface circuitry 38, shown as a block in FIG. 1, between the circuitry 36 of FIG. 5 and the visual display indicated in FIG. 1. The interface circuitry 38 preferably comprises a total of seven well known integrated circuit chips plus three LED digits. The integrated circuit chips are a counting chip, three latching chips, and three driver chips.

All seven IC's are well known in the art and perform well known functions. For example, the counting chip receives its input information from the terminals H, I, J, and K with respect to the time selected by the procedure outlined above. The latching chips hold the last piece of information between the clock pulses produced by the counting chip. The three drivers take the information in binary coded decimal (BCD) form, and convert the information to seven segment display form which in turn is used for the respective three digits or numerals 30, 32, and 34.

It will be noted that while there is only one counting chip needed, there are three latching chips and three driver chips, one for each of the three digits or numerals. The three numerals 30, 32, and 34, illustrated in FIG. 1, comprise seven segment display LED's for visual readout.

As indicated previously, the apparatus of the present invention counts down rather than up. Accordingly, when the apparatus is activated, the maximum time selected appears first as information in terms of hours, ten minutes, and minutes, on the numerical display characters 30, 32, and 34, respectively. The numerical characters or digits in turn count down from the maximum time selected to the end of the selected time period.

Figure 6:
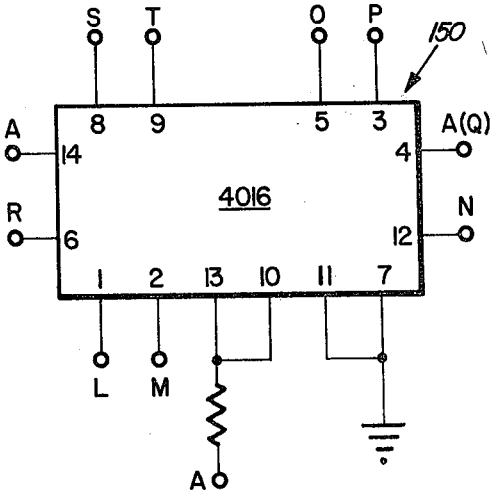
FIG. 6 is a schematic diagram of alternate circuitry for the apparatus of the present invention.

FIG. 6 is a schematic diagram of an analog switch integrated circuit, such as a 4016, which may be used in the apparatus of FIG. 6 to replace transistors 44, 46, and 88. It will be noted in FIG. 5 that the three connections for each of the transistors 44, 46, and 88, namely the base, emitter, and collector, have been given an alphabetical or letter designation. The base of transistor 44 has been designated with reference letter O, the emitter of transistor 44 with letter P, and the collector of transistor 44 with letter Q. The collector, emitter, and base of transistor 88 have been designated respectively by letters L, M, and N. The base, collector, and emitter of transistor 46 have been respectively designated by leters R, S, and T. In FIG. 6, the respective terminals of the IC 150 are shown with the respective letters connected to the identified pins of the 4016 chip. In addition to the circuit connections, other pins of the chip are also indicated as being connected to ground and to a voltage source through a biasing resistor.

It will be noted in the schematic diagrams that only certain components have been specifically identified with reference numerals. For example, various components, such as various conductors, the two capacitors, the four diodes, the two variable resistors, and the various fixed resistors in FIG. 5 have not been specifically identified. Their use in the circuitry is well known and understood. For example, the two capacitors comprise timing capacitors, and the variable resistors comprise timing resistors, both of which functions are well known and understood. The diodes comprise blocking diodes, and the fixed resistors comprise biasing resistors, again both of which functions are well known and understood.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Coin operated timing apparatus comprising, in combination:

coin receptor means for receiving a coin;

coin identification means for identifying the coin received by the coin receptor means;

switch means for selecting a time period in response to the coin received by the coin receptor means and identified by the coin identifying means;

timing means for enabling the switch means and for limiting the time in which the switch means may be activated to select the time period;

timer means including clock means for counting the selected time period; and output means for producing an output signal at the end of the selected time period.

2. The apparatus of claim 1 in which the switch means for selecting a time period comprises a plurality of switches and each switch of the plurality of switches when activated selects a different time period.

3. The apparatus of claim 1 in which the output means includes means for providing an audible signal.

4. The apparatus of claim 3 in which the timer means includes means for actuating the output means to provide the audible signal at the end of the selected time period.

5. The apparatus of claim 1 in which the timer means further includes means for resetting the timing means at the end of the selected time period to allow the selection of another time period when a coin is identified by the coin identifying means.

6. The apparatus of claim 5 in which the coin identifying means comprises a pair of infrared LED optoisolators connected together.

7. The apparatus of claim 5 in which the output means includes means for providing a visual signal for displaying the time remaining in the selected time period.

8. The apparatus of claim 5 in which the timer means further includes means for resetting the clock means at the end of the selected time period.

9. The apparatus of claim 5 in which the coin identification means includes switch means for selecting the number of coins required to enable the timing means.

* * * * *